United States Patent [19]

Hutner

[11] 3,939,326

[45] Feb. 17, 1976

[54] DUAL RIBBON FUSER

[75] Inventor: Mark A. Hutner, Glenview, Ill.

[73] Assignee: Xerox Corporation, Stamford, Conn.

[22] Filed: Jan. 6, 1975

[21] Appl. No.: 538,705

[52] U.S. Cl. ..... 219/216; 219/388; 338/49; 338/316; 338/319

[51] Int. Cl.[2] ..... H05B 1/00

[58] Field of Search ..... 219/216, 388; 432/59, 227; 338/316, 13, 49, 319

[56] References Cited

UNITED STATES PATENTS

| | | | |
|---|---|---|---|
| 2,912,661 | 11/1959 | Balestrini | 338/316 X |
| 3,079,483 | 2/1963 | Codichini et al. | 219/216 |
| 3,649,808 | 3/1972 | Garbe | 219/216 |
| 3,781,516 | 12/1973 | Tsilibes et al. | 219/216 |
| 3,781,517 | 12/1973 | Skamra | 219/216 |

*Primary Examiner*—C. L. Albritton

[57] ABSTRACT

A fuser includes a pair of members defining a zone, a pair of electrical elements supported in series with a power supply by one of the members, and a thermostatic switch being electrically connected in parallel with one of the elements. When the temperature in the zone is below a predetermined level the switch is closed and shorts out the element with which it is in parallel. The switch opens when the temperature rises above said predetermined level, whereby less heat is provided for the zone. This arrangement provides a rapid warm up for the zone. Heat distribution in the zone is achieved by supporting the heating elements in zigzag fashion. Sagging of the elements thus mounted is prevented by bias means which maintain the elements under tension.

5 Claims, 3 Drawing Figures

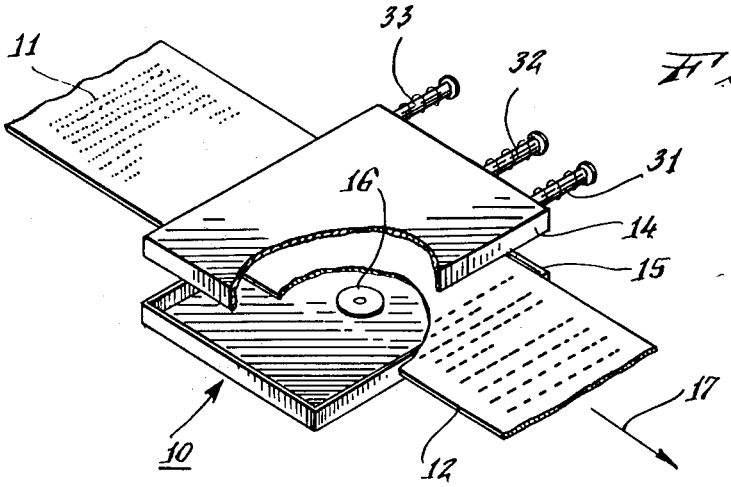
Fig. 1
Fig. 2
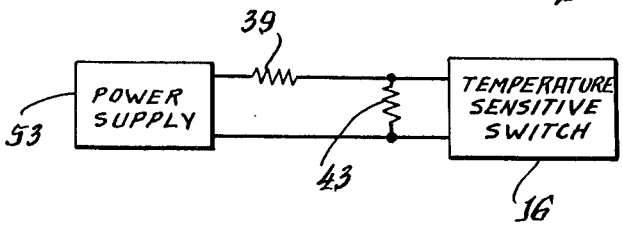
Fig. 3
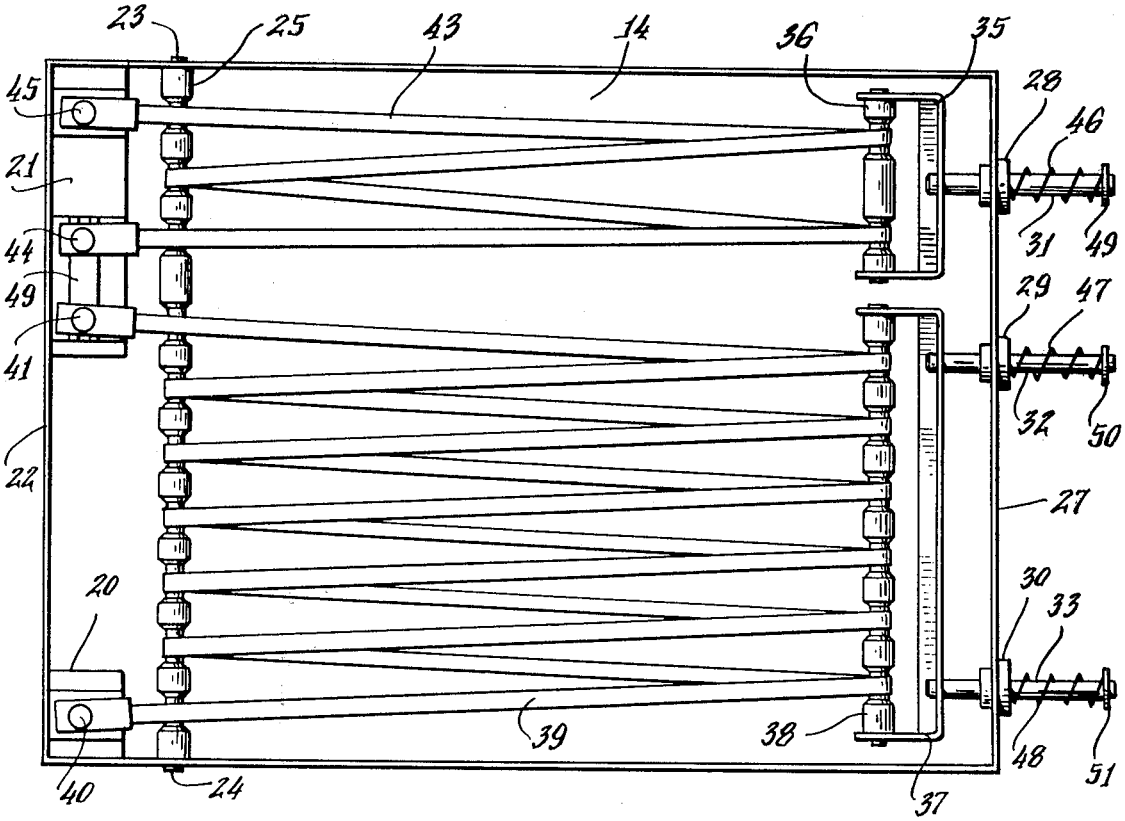

DUAL RIBBON FUSER

The subject invention relates to radiant heaters of the type used in xerography to fix or fuse toner images on a substrate such as paper.

As is well known, in xerography toner images formed on a xerographic plate or drum are transferred to sheet paper and are fused thereto, according to at least one method, by the application of heat from an electrical element to the toner bearing sheet. In fact, U.S. Pat. No. 2,965,868, issued to R. W. Eichler on DEc. 20, 1960, discloses xerographic apparatus which utilizes a fuser comprising a small diameter quartz tube encircled by a fine coil of nichrome wire to provide a heating element of low thermal mass. The coil is supported by the quartz tube to prevent its sagging when heated. As a result, the wire may be closely spaced with regard to images to be fixed thereby and less electrical power is required to accomplish fusing. In the fuser described above the use of a heating element having a low thermal mass is important because the fuser may be brought up to operating temperature quickly, thereby reducing the standby period required before the xerographic apparatus can be used, and may be dropped quickly to prevent charring of paper remaining adjacent the fuser for more than some predetermined period of time.

It is an object of the present invention to provide a fuser for xerographic apparatus, which fuser is capable of further reducing the time required to reach operating temperature.

It is another object of the present invention to provide a fuser having heating elements which may be positioned in closely spaced parallel relation to paper without danger of the heating element deforming and contacting the paper.

In summary, the invention provides apparatus for fixing toner on a substrate as the substrate, which may be paper, is moved through a zone. Structurally, the apparatus comprises: (a) first and second members disposed on opposite sides of said zone; (b) an electrical power source; (c) a pair of electric heating elements coupled to the power source; (d) means coupling the heating elements to said first member for heating the zone; and (e) means, responsive to the temperature in the zone, coupled to the heating elements for changing the electrical load provided by the heating elements at the power supply, the load being smallest when the temperature in the zone is lower than a predetermined temperature.

Additional objects and features of the invention will become apparent by reference to the following description in conjunction with the accompanying drawings, in which:

FIG. 1 is a partial perspective view of a xerographic fuser, according to the invention, a section having been broken away to show a temperature sensitive switch of the fuser;

FIG. 2 is a schematic diagram showing electrical connections of parts of the fuser; and FIG. 3 is a plan view of a member of the fuser and heating elements coupled thereto.

A fuser 10, according to the invention, for fixing toner 11 on a substrate such as paper 12 is shown in perspective in FIG. 1, parts normally required for coupling the fuser to a xerographic machine having been omitted in the interest of conciseness and in view of the belief that such coupling may be carried out by any person skilled in the xerographic art. Referring to FIG. 1, fuser 10 includes an upper member 14 supporting, as more fully discussed below, heating elements, and a lower member 15 supporting a temperature sensitive switch 16, the members 14 and 15 being spaced to provide a substantially convection free zone through which paper 12 may be drawn in the direction indicated by arrow 17. Apparatus for drawing the paper may be, if desired, such as is disclosed in conjunction with a xerographic machine in U.S. Pat. No. 2,965,868, issued to R. W. Eichler on Dec. 20, 1960.

Referring to FIG. 3, member 14 generally resembles a box cover and in this example is manufactured from sheet metal. One corner of member 14 supports an insulator 20 which, for example, may be manufactured from machinable ceramic, and adjacent another corner there is supported another insulator 21 which may be manufactured from the same material. Parallel to the wall 22 commmon to said corners and spaced from the top of the member there is supported by screws 23 and 24 an insulator in the form of a ceramic rod 25 having annular grooves, the grooves being adapted, as more fully discussed below, to support the heating elements. Opposite wall 22, a wall 27 supports three sleeves 28–30, each of the sleeves slidably supporting links 31–33, respectively. Link 31 is connected to a bracket 35 which supports an insulator in the form of a ceramic rod 36 having annular grooves and links 32 and 33 are connected to a bracket 37 which supports an insulator in the form of a ceramic rod 38 having annular grooves, the rods 36 and 38 being parallel to rod 25. One of the heating elements 39 is disposed in zigzag fashion between rods 25 and 38 and its ends, respectively, are fastened by terminals 40 and 41 to insulators 20 and 21. Similarly, the other of the heating elements is disposed in zigzag fashion between rods 25 and 36 and its ends, respectively, are fastened by termminals 44 and 45 to insulator 21, terminals 41 and 44 being electrically connected by an electrical shorting strap 49. The zigzag arrangements are maintained under tension by springs. More specifically, link 31 supports an abutment and is encircled by a compression spring 46 engaging the abutment 49 and sleeve 28, as a result of which element 43 is placed under tension. Similarly, abutments 50 and 51 on links 32 and 33, respectively, cooperate with springs 47 and 48 to keep element 39 under tension. With this arrangement, if electrical power is connected to either or both of the heating elements any expansion or contraction of the elements due to temperature variations is accommodated and sagging which would otherwise result is substantially eliminated.

Referring to FIGS. 2 and 3, temperature sensitive switch 16 is electrically connected in parallel with element 43, via terminals 44 and 45, and the series connection of elements 39 and 43 are connected via terminals 40 and 45, to a power supply 53. Temperature sensitive switch 16 remains closed below a predetermined temperature and electrically provides an open circuit above said temperature. As a result, with a fixed output voltage from power supply 53, when the power supply 53 is switched on if, referring to FIG. 1, the temperature in the zone between the members 14 and 15 is below said predetermined temperature the element 43 is shorted out and heat is provided by element 39. When the zone temperature rises above the predetermined temperature the switch opens and heat is provided by both elements 39 and 43 but at a lower rate because of the higher resistance seen by power supply 53. The arrangement described results in a fuser which provides a steady state heat output for fusing toner onto paper 17 and a high heat output for rapidly bringing the fuser up to the steady state level.

It should be noted that the temperature resistive switch may be a thermostat which is mounted on member 10 so as to be shielded by paper 12 from direct radiation from the elements 39 and 43. In consequence, the thermostat is primarily responsive to the temperature of the zone.

In the embodiment of the invention described above, heating elements 39 and 43 may be manufactured from ribbon lengths of an alloy consisting of, for example, 60% nickel, 16% chromium and a balance of mainly iron, such as is sold by the Hoskins Manufacturing Co. under the mark "Chromel C".

It will be appreciated by those skilled in the art that the series arrangement of elements disclosed may be replaced, for example, by an arrangement wherein a first element is connected to a power supply and a series combination of a second element and a temperature responsive switch are shunted across the first element. With this arrangement, when the temperature in the zone is below a predetermined level the switch would be closed and when the temperature rises the switch would be opened to cut down on the heat being supplied to the zone. However, despite the fact that a parallel arrangement can be used, for given heat requirements the parallel arrangement requires the use of elements having higher resistance values and this imposes the need to either use longer heating elements or elements manufactured from materials having a higher resistivity.

It is to be understood that the description herein of a preferred embodiment, according to the invention, is set forth as an example thereof and is not to be construed or interpreted as a limitation on the claims which follow and define the invention.

What is claimed is:

1. Apparatus for fixing toner on a substrate, as the substrate is moved through a zone, comprising:

a. first and second members disposed on opposite sides of said zone;

b. an electrical power source;

c. a pair of electric heating elements, connected in series, coupled to the power source;

d. means coupling the heating elements to said first member for heating the zone; and e. means, responsive to the temperature in the zone, for shorting out one of the heating elements when the temperature in the zone is lower than a predetermined temperature.

2. Apparatus as defined in claim 1 wherein said means responsive to the temperature includes a thermostat located such that when the substrate is in the zone the heating elements and the thermostat are on opposite sides thereof.

3. Apparatus as defined in claim 2 wherein at least one of the heating elements is an elongated metallic ribbon, the ribbon being coupled to the first member in zigzag fashion.

4. Apparatus as defined in claim 1 wherein said coupling means include first means for supporting at least one of the heating elements in a zigzag arrangement.

5. Apparatus as defined in claim 2 wherein at least one of the heating elements is an elongated metallic ribbon.

* * * * *